United States Patent [19]

Brettbacher et al.

[11] Patent Number: 4,580,428

[45] **Date of Patent: * Apr. 8, 1986**

[54] HOT-ROLLING MILL AND PROCESS FOR PRODUCING SHEET METAL

[75] Inventors: Franz Brettbacher; Uwe Langer, both of Linz, Austria

[73] Assignee: Voest-Alpine Aktiengesellschaft, Linz, Austria

[ * ] Notice: The portion of the term of this patent subsequent to Feb. 5, 2002 has been disclaimed.

[21] Appl. No.: 634,963

[22] Filed: Jul. 27, 1984

Related U.S. Application Data

[63] Continuation-in-part of Ser. No. 358,061, Mar. 15, 1982, abandoned.

[30] Foreign Application Priority Data

Mar. 25, 1981 [AT] Austria ..... 1382/81

[51] Int. Cl.[4] ..... B21B 41/06

[52] U.S. Cl. ..... 72/226; 72/229; 72/234

[58] Field of Search ..... 72/229, 234, 226

[56] References Cited

U.S. PATENT DOCUMENTS 3,331,232 7/1967 King ..... 72/365
4,497,191 2/1985 Langer et al. ..... 72/234

*Primary Examiner*—Francis S. Husar
*Assistant Examiner*—Jorji M. Griffin
*Attorney, Agent, or Firm*—Kurt Kelman

[57] ABSTRACT

A hot-rolling mill for producing sheet metal has a reversing roughing stand having pairs of roughing rolls and a reversing finishing stand adjacent thereto and having pairs of finishing rolls. Each stand is selectively operable alone and both stands are operable in tandem operation. The roughing rolls have diameters larger than the diameters of the finishing rolls and the finishing rolls operate at a higher rotary speed than the roughing rolls in the tandem operation.

3 Claims, 2 Drawing Figures

HOT-ROLLING MILL AND PROCESS FOR PRODUCING SHEET METAL

Figure 1:
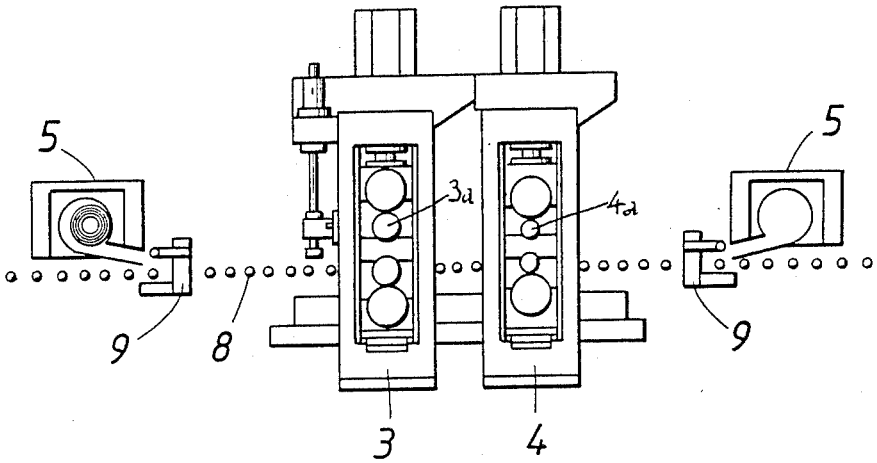

This is a continuation-in-part of our copending U. S. patent application Ser. No. 358,061, filed Mar. 15, 1982, now abandoned.

This invention relates to a hot-rolling mill for producing strip or sheets comprising a reversing roughing stand and a reversing finishing stand.

In hot-rolling mills designed for a low or medium capacity, it is not desired to use a single pair of working rolls for the roughing and finishing passes but to provide in known manner a roughing stand and a separate finishing stand. In that case the surface roughness and diameter of the rolls can be selected with a view to the requirements of the desired deformation and working rolls which are larger in diameter and have rougher surfaces can be used for the roughing passes. On the other hand, the capacity of the roughing stand is only poorly utilized in such mill and the transfer of the stock from the roughing stand to the finishing stand inevitably involves a large heat loss so that particularly in the production of light-gage hot-rolled strip the stock will cool below the temperatures required for finishing, particularly if the coils are heavy. It must also be borne in mind that a considerable heat loss takes place during the considerable number of finishing passes required to obtain a rolled stock of high quality. Moreover, a descaling of strip to be rolled will be permissible only if only one or a few finishing passes are performed because otherwise the heat loss will be excessive. For this reason it is virtually impossible to produce in such a plant a rolled strip having a satisfactory surface finish. The inevitable heat loss imposes also a lower limit regarding the thickness of the strip because the lowest permissible strip temperature will be reached if the strip is rolled to a thickness of about 2 mm.

In order to permit a rolling with a lower number of passes so that the heat loss will be decreased, French Pat. No. 1,132,772 provides two or three closely spaced stands so that the stock is rolled in the stands at the same time and fewer passes are sufficient. But such known rolling mills have the disadvantage that the stands are similar and the diameter and surface roughness of their rolls cannot be so selected that they take into account the requirements of the respective rolling operation. If such a two-stand mill were preceded by a roughing stand, the disadvantages which are inherent in the use of a roughing stand would not be eliminated.

It is an object of the invention to avoid these disadvantages and so to improve a hot-rolling mill for producing strip or sheets that light-gage hot-rolled strip having a high surface finish can be economically produced even when coils of medium or high weight are to be obtained.

The above and other objects are accomplished according to one aspect of the invention with a hot-rolling mill for producing sheet metal, which comprises a reversing rough stand having pairs of roughing rolls and a reversing finishing stand adjacent thereto and having pairs of finishing rolls, wherein the roughing rolls have diameters larger than the diameters of the finishing rolls and the finishing rolls are operable at a higher rotary speed than the roughing rolls. Each stand is selectively operable alone and both stands are operable in tandem operation, the finishing rolls being operated at the higher rotary speed in the tandem operation.

According to another aspect of the present invention, sheet metal is produced in a hot-rolling process wherein at least one roughing pass is performed in a first reversing stand and at least one finishing pass is performed in a second reversing stand disposed adjacent the first stand, the one roughing pass being performed while the second stand is inoperative and the one finishing step is performed subsequently in the first and second stands in tandem operation.

Preferably, the one finishing pass performed in the first and second stands in the tandem operation precedes at least one finishing pass performed in the second stand.

Because the two rolling stands are adjacent each other, the roughing stand and the finishing stand can be operated in a tandem operation in which the thickness of the stock can be reduced quickly whereas the capacity of the roughing stand is utilized to a high degree. As a result, the stock can be finished to a light gage when it is still at a permissibly high temperature. In that case, the use of a roughing stand will not adversely affect the surface finish of the rolled stock because the roughing stand is succeeded by the finishing stand and the last pass or passes can be performed with the finishing stand alone. It will be understood that the roughing stand is used for the conventional roughing passes.

Because the thickness of the stock can be reduced quickly, strip can be hot-rolled to a thickness below 2 mm at a sufficiently high final temperature and the plant will have a higher capacity than hot-rolling plants in which the roughing and finishing stands are operated separately.

Figure 2:
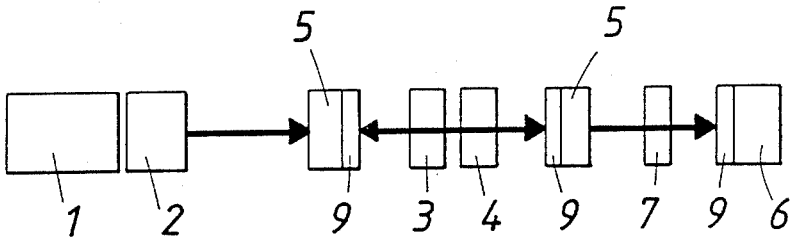

The invention is illustrated schematically by way of example on the drawing in which FIG. 1 is a side elevation showing a plant according to the invention for hot-rolling stock in strip or sheet form, and FIG. 2 is a block circuit diagram of a hot-rolling plant according to the invention.

As is apparent from FIG. 2, the stock to be rolled is heated to the desired rolling temperature in a furnace 1. The heated stock is then descaled in a hydraulic descaler 2 and is subsequently delivered to reversing roughing stand 3 and thereafter to reversing finishing stand 4, which is adjacent roughing stand 3. The roughing stand 3 is preceded by holding furnace 5. Another holding furnace 5 succeeds finishing stand 4. These holding furnaces are provided to avoid excessively large heat losses. The finished hot-rolled strip is wound on an upcoiler 6, which is preceded by a shearing machine 7. Pinch roll units 9 for advancing the stock on roller conveyor 8 are provided at suitable locations.

The plant shown in FIG. 1 differs from conventional hot-rolling mills of a similar kind in that roughing stand 3 and finishing stand 4 are adjacent each other, and each of them can be operated alone and in a tandem operation with the other. To make this possible, reversing roughing stand 3 has pairs of roughing rolls 3*a* having diameters larger than the diameters of the pair of finishing rolls 4*a* of reversing finishing stand 4. The roughing and finishing rolls are rotatable independently of each other, finishing rolls 4*a* being operable at a higher rotary speed than roughing rolls 3*a*. In the tandem operation, the finishing rolls are operated at the higher rotary speed. When the finishing stand is operated alone, the passing speed of the strip, which determines the rotary speed of the rolls, may be the same as that selected for passing through the roughing stand.

When the required number of roughing passes have been performed, stands 3 and 4 can be operated at the same time so that the stock will quickly be reduced in thickness. In this way, the heat losses will be greatly reduced so that the descaling will be improved and the finished strip will have a higher surface finish. Besides, the present plant has a higher capacity and its length is smaller by about one-third so that the prime cost is greatly reduced. The surface finish of the rolled stock is also improved by the fact that the roughing and finishing passes are performed in separate stands and the work rolls will have a comparatively long life because the operations are divided into a plurality of passes. It will be understood that the plant can be used for various rolling operations as each of the stands can be used individually or in combination with the other stand.

What is claimed is:

1. A hot-rolling mill for producing sheet metal, comprising a reversing stand having pairs of roughing rolls and a reversing finishing stand adjacent thereto and having pairs of finishing rolls, the roughing rolls having diameters larger than the diameters of the finishing rolls and the finishing rolls being operable at a higher rotary speed than the roughing rolls, each of said stands being selectively operable alone and both stands being operable in tandem operation, and means for operating the finishing rolls at the higher rotary speed in the tandem operation.

2. In a hot-rolling process of producing sheet metal, comprising at least one roughing pass performed in a first reversing stand and at least one finishing pass performed in a second reversing stand disposed adjacent said first stand, the steps of performing said at least one roughing pass while said second stand is inoperative and subsequently performing said at least one finishing pass in said first and second stands in tandem operation.

3. In the process set forth in claim 2, said at least one finishing pass being performed in said first and second stands in tandem operation before at least one finishing pass is performed in said second stand alone.

* * * * *